United States Patent [19]

Barton et al.

[11] 4,212,665

[45] Jul. 15, 1980

[54] DECARBURIZATION OF METALLIC ALLOYS

[75] Inventors: Bruce L. Barton, Utica; Walter E. Johnson, Clinton; Anthony J. Notaro, Whitesboro, all of N.Y.

[73] Assignee: Special Metals Corporation, New Hartford, N.Y.

[21] Appl. No.: 928,768

[22] Filed: Jul. 27, 1978

[51] Int. Cl.[2] ..... C22B 4/00; C21C 7/10

[52] U.S. Cl. ..... 75/10 V; 75/10 R; 75/49; 75/57

[58] Field of Search ..... 75/57, 49, 10 R, 10 V, 75/12

[56] References Cited

U.S. PATENT DOCUMENTS

| | | | |
|---|---|---|---|
| 2,767,077 | 10/1956 | Perrin | 75/56 |
| 2,983,598 | 5/1961 | Wheatley | 75/56 |
| 3,737,302 | 6/1973 | Pomey | 75/49 |

*Primary Examiner*—P. D. Rosenberg

*Attorney, Agent, or Firm*—Vincent G. Gioia; Robert F. Dropkin

[57] ABSTRACT

An improvement in the manufacture of metallic alloys, and particularly in that stage of production wherein the alloy is decarburized. By adding an oxide of an element of the alloy being produced to the melt-down charge or to the melt, along with a flux which lowers the melting point of the oxide; an improvement is provided in the decarburization of metallic alloys.

5 Claims, No Drawings

DECARBURIZATION OF METALLIC ALLOYS

The present invention relates to the decarburization of metallic alloys.

Metallic alloys have been effectively decarburized by melting charges which contain appreciable quantities of dissolved oxygen, and by subjecting the melt to subatmospheric pressures. Such processing is, however, accompanied by large variations in decarburization rates and erratic variations in attained carbon levels. Additions of oxides of one or more elements of the alloy do not overcome this problem, although they do appear to provide some benefit.

Through the present invention a means is provided for reducing the variations in decarburization rates and for rendering the attainment of low carbon levels more consistent. An oxide of an element of the alloy being produced is added to the melt-down charge or to the melt, along with a flux which lowers the melting point of the oxide. The flux causes the oxide to assimilate with the molten alloy. Oxides added without flux have been observed to float on the melt surface and/or adhere to the crucible side wall and collar.

Fluxes such as those embraced by the present invention are added during air melting to keep the protective slag fluid. Such fluxes have not, however, been added to vacuum melted heats which do not require a protective slag.

It is accordingly an object of the present invention to provide an improvement in the decarburozation of metallic alloys.

The present invention provides an improvement in the manufacture of metallic alloys, and particularly in that stage of production wherein the alloy is decarburized. Although the invention is adaptable for use with many alloys, it is particularly beneficial for alloys from the group consisting of iron, nickel and cobalt base alloys. The process includes the steps of charging a furnace, melting the charge, decarburizing the melt in a subatmospheric pressure and casting the melt. No criticality is attributable to the conventional steps. The subatmospheric pressure is usually less than 150 microns at the start of decarburization, and preferably less than 50 microns. Melting usually occurs in an induction furnace.

By adding an oxide of an element, usually a major element, of the alloy being produced to the melt-down charge or to the melt, along with a flux which lowers the melting point of the oxide; the present invention provides an improvement in the decarburization of metallic alloys. The flux causes the oxide to assimilate with the molten alloy. Oxides added without flux have been observed to float on the melt surface and/or adhere to the crucible side wall and collar. Silica and calcium fluoride are typical fluxes.

The following examples are illustrative of several aspects of the invention.

EXAMPLE I.

A vacuum induction furnace was charged to yield an alloy having a nominal composition of 26.0% chromium, 1.0% molybdenum, balance iron. The charge was melted and decarburized. The pressure in the furnace was under 30 microns at the start of decarburization. The temperature in the furnace was approximately 2950° F. After 3.5 hours the carbon content was in excess of 0.007%. A carbon content of less than 0.003% was desired. Decarburization was painfully slow.

As additions of iron-oxide had previously been added to similar heats, with no meaningful effect on the decarburization rate or carbon level attained; a different approach was attempted. Iron oxide pellets were mixed with a flux (silica firebrick), and added to the melt. The flux lowered the melting point of the oxide pellets, and in turn drastically increased the rate of decarburization. The carbon level was below 0.003% in slightly more than 2.5 hours. A level which would not have been achieved in a reasonable period if not for the addition of both the oxide pellets and flux.

EXAMPLE II

Ten heats having a chemistry similar to that for the heat of Example I were processed in a similar manner as was the heat of Example I. Iron oxide pellets and silica were, however, added to the charge instead of the melt. The heats achieved a carbon content of less than 0.003% in from 90 to 120 minutes after the melt was heated to 2950° F.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

We claim:

1. In a process for producing a metallic alloy, which process includes the steps of: charging a furnace; melting the charge; decarburizing the melt in a subatmospheric pressure; and casting the melt; the improvement comprising the steps of decarburizing said melt by adding both an oxide of an element of said alloy and a flux, said flux lowering the melting point of said oxide, said flux causing said oxide to assimilate with said melt; and by maintaining said melt at an elevated temperature in said subatmospheric pressure for a period of time sufficient to lower said melts carbon content to a desired level, oxygen within said oxide reacting with carbon within said melt to form gaseous compounds which emerge from said melt.

2. A process according to claim 1, wherein said subatmospheric pressure is less than 150 microns at the start of decarburization.

3. A process according to claim 2, wherein said subatmospheric pressure is less than 50 microns at the start of decarburization.

4. A process according to claim 1, wherein said metallic alloy is from the group consisting of iron, nickel and cobalt base alloys.

5. A process according to claim 1, wherein said charge is melted and decarburized in an induction furnace.

* * * * *